United States Patent [19]

McGruder

[11] 4,126,256

[45] Nov. 21, 1978

[54] CARRIER CASE FOR ICE SKATES, ROLLER SKATES, BOOTS AND SHOES

[76] Inventor: Jerome McGruder, 9844 S. Merrill, Chicago, Ill. 60617

[21] Appl. No.: 821,701

[22] Filed: Aug. 4, 1977

[51] Int. Cl.[2] ..... B65D 71/00

[52] U.S. Cl. ..... 224/45 S; 224/44; 190/41 R

[58] Field of Search ..... 224/45 S, 43, 44, 5 P, 224/5 R, 45 R; 280/11.37, 11.37 R, 11.38; 150/52 G; 206/294, 487; 36/115; 190/51, 52, 43, 41 R; 12/120.5

[56] References Cited

U.S. PATENT DOCUMENTS

| | | | |
|---|---|---|---|
| 1,281,822 | 10/1918 | Orr | 224/5 P |
| 2,405,744 | 8/1946 | Glass | 224/44 |
| 2,672,263 | 3/1954 | Alber | 224/45 S |
| 3,348,665 | 10/1967 | Andretich | 224/45 S |
| 3,369,666 | 2/1968 | Hartman | 206/294 |
| 3,399,750 | 9/1968 | Woolworth | 224/45 S |
| 3,749,232 | 7/1973 | Craig | 224/45 S |

*Primary Examiner*—Trygve M. Blix
*Assistant Examiner*—Kenneth W. Noland
*Attorney, Agent, or Firm*—Ronald A. Sandler

[57] ABSTRACT

An improved carrier case for roller skates, ice skates, boots and the like articles, having a first and second compartment for enclosure of the article. Each of the compartments is shaped substantially to the form of the article contained therein and flexible connection member connect the top portion of each of the compartments together. Article restraint devices are utilized within the interior of each of the compartments for restrainably maintaining the positions of the enveloped articles and for protecting the articles themselves. Receivable entry zippers are further associated with each of the compartments to provide for the user easy access into the interior of each of the compartments for inserting, storing, and removing the articles as desired.

5 Claims, 6 Drawing Figures

CARRIER CASE FOR ICE SKATES, ROLLER SKATES, BOOTS AND SHOES

BACKGROUND OF THE INVENTION

The present invention relates in general to article carrying cases and, in particular, to an improved carrier case for roller skates, ice skates, boots and similar articles.

With the increased popularity of roller skating and ice skating, many of the problems involved with a user carrying his skates to and from a skating location have become readily apparent.

A skater carrying his or her skates without a protective apparatus to contain them, runs the risk of losing one or more of their skates, damaging the rollers or blades associated therewith, and damaging or scratching other property with which the skates might come into contact such as floors, tables and the like. A skater may become frustrated with the substantially cumbersome job of carrying articles which can injure him or her if they are inadvertently pushed, or fall while such skates are slung over the user's shoulder.

The most conventional method of carrying such skates is through knotting the skate strings or laces together and slinging the knotted laces over the user's shoulder or across the user's arm. Through such a method, a great degree of discomfort is experienced as the laces bite into the user's shoulder or arm from the suspended weight of the skates as well as the problems illustrated above.

It is thus an object of the present invention to provide an improved carrier case for roller skates, ice skates, boots, shoes, and similar articles, which is comfortable and efficient for the user to carry and which protects the associated articles from moisture, dirt and impairment of the blades or rollers associated therewith.

It is further an object of the present invention to provide a carrier case apparatus which effectively restrains the articles within a protective compartment which minimizes shifting of the substantially weighted items within the compartment while at the same time protecting the blades or rollers from coming into contact with the user or other personal property.

It is also an object of the present invention to provide a carrier case for the above mentioned articles which is convenient and comfortable to carry, while at the same time easy to use through the provision of appropriate entry means to provide access to the interior of the compartment. To this extent, it is an object of the invention to arrange the compartment so that it is balanced uniformly when articles are inserted therein, and which is thus capable of being used in a facilitated manner without the presentation of discomfort to the user.

These and other objects of the invention will become apparent in light of the present specification.

SUMMARY OF THE INVENTION

The present invention comprises an improved carrier case for roller skates, ice skates, boots and the like, comprising first and second article compartments for enveloping each of the articles respectively. Each of the first and second compartment means is substantially L-shaped to closely approximate and surround the enveloped articles, and flexible connection means are attached to the top portions of each of these compartments to connect them together. Article restraint means are utilized within the interiors of both the containers along the bottom portions of each for restrainably maintaining the positions of the enveloped articles. Resealable entry means in each of the compartments are used for alternatively exposing and sealing the interior of each of the compartments to a user whereby insertion, storage and removal of the article into and from the compartments may be accomplished effectively.

In the preferred embodiments of the invention, the improved carrier case has within each of the compartments, padding means along the interior for further enveloping the article and for lending additional rigid restraint of the article within the compartments. Preferably, the compartments are fabricated of a substantially waterproof flexible material to provide protection for the articles while providing facilitated use and carrying by the user.

As stated above, each of the two compartments are attached together through flexible connection means. Further, in the preferred embodiment, these flexible connection means connect the compartments in oppositely facing directions in order to balance the suspended weight of the compartments and the articles within, on either side of a transverse axis drawn through the compartment means and connecting means, for facilitated handling by the user. The flexible connection means comprise a substantially soft flexible flat band of material for placement alternating between a user's shoulder and the user's hand and provide means from which the compartments suspend when carried by the user. Separate handle means attached to the top facing side of the substantially flexible flat band of material can be utilized to provide facilitated carrying in the user's hand.

The article restraint means comprises one or more fixture devices in the bottom of each of the first and second compartments said fixture devices having a top surface exposed to the stored article. This top surface has one or more indentations fabricated therein for snug and aligned receipt of a roller skate bearing wheel for restraining roller skate articles in place within each of the said compartments. Equivalently, the article restraining means in another embodiment comprises one or more fixture devices in the bottom of the first and second compartments, each having a top surface exposed to the article, in which the top surface has one or more indentations for snug aligned receipt of an ice skate blade for in turn restraining and protecting ice skate articles in place within each of the compartments respectively. In the preferred embodiment of the invention, these restraining means are removable from each of the compartments respectively to provide interchangeability among the article restraining means so as to be capable of converting the article carrier case from an ice skate carrying device to a roller skate carrying device and for further enabling the carrier case to protectively carry many types of articles including shoes and boots.

The resealable entry means are positioned along the back side of each of the L-shaped compartments for facilitated access into the interior of the compartments respectively. These entry means in one embodiment comprise a substantially heavy-duty zippr device and in another embodiment comprise a plurality of male and female buckling fasteners.

DETAILED DESCRIPTION OF THE DRAWINGS

Figure 1:
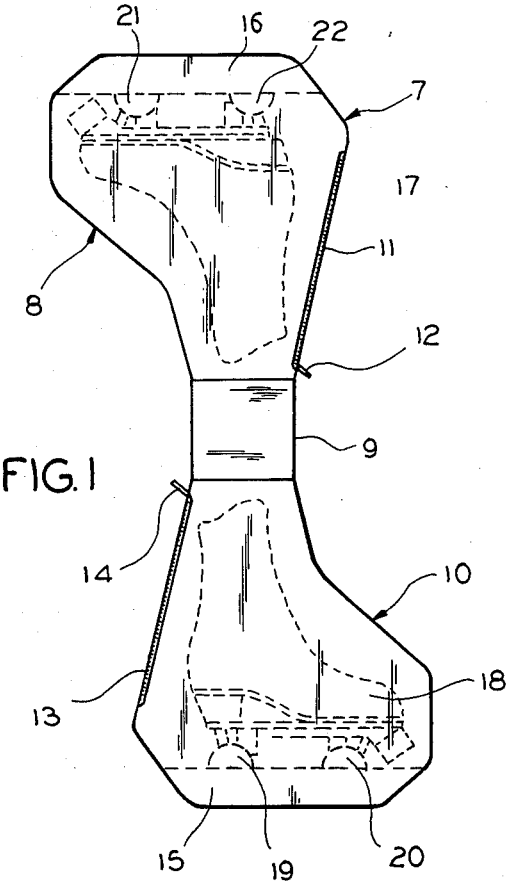
FIG. 1 of the drawings is a top plan view of the unsuspended carrier case device showing the connected compartments containing roller skates therein.

While this invention is susceptible of embodiments in many different forms, there is shown in the drawings and will herein be described in detail, several specific embodiments, with the understanding that the present disclosure is to be considered as an exemplification of the principles of the invention and is not intended to limit the invention to the embodiments illustrated.

The improved carrier case 7 is shown in FIG. 1 with compartment portions 8 and 10 connected by flexible connection means 9 connected at their tops respectively. Resealable entry means 11 and 13 comprising substantially heavy-duty zipper mechanisms 12 and 14, respectively, are utilized to provide access into each of the compartments respectively. Additionally, article restraining means 16 and 15 are shown restraining roller skate wheels 21 and 22; and 19 and 20 respectively.

Figure 2:
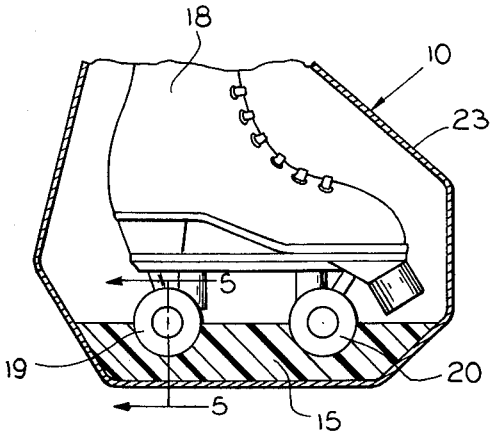
FIG. 2 is an enlargement of one of the compartments of the carrier case showing particularly placement and utilization of article restraining means therein for a roller skate article.

Closer examination of compartment 10 is shown in FIG. 2 in which roller skate 18 is positioned within compartment 10 formed by substantially waterproof flexible material 23. Roller skate bearings 19 and 20 are shown firmly received by article restraining means 15, through indentations formed in the surface of article restraint means 15.

Figure 3:
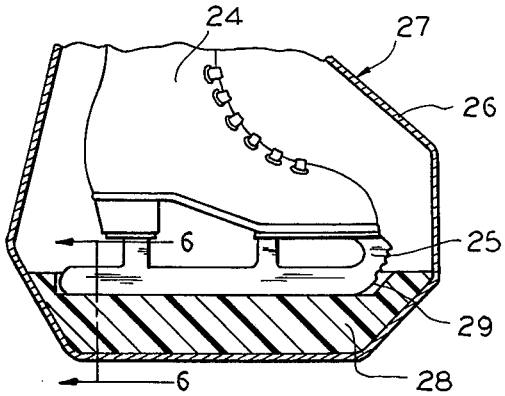
FIG. 3 is an enlargement of one of the compartment portions as shown in FIG. 2 showing particularly the article restraining means utilized in association with an ice skating article.

In equivalent fashion to the manner in which a roller skate is restrained, as shown in FIG. 2, an ice skate such as ice skate 24 is maintained in place within compartment 27 as shown in FIG. 3. Ice skate blade 25 is received by indentation 29 in article restraint means 28. As should be apparent, article restraint means 15 of FIG. 2 and article restraint means 28 of FIG. 3 are preferably removable from the respective compartments to allow for the interchangeability of each depending on what type of article is to be used, and for utilization of the carrier case for articles not requiring article restraining means at all such as boots and shoes.

Figure 4:
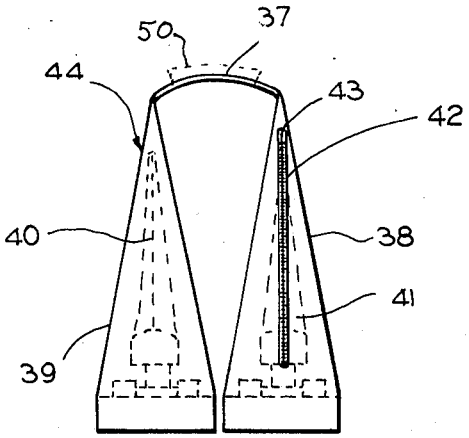
FIG. 4 is a front elevational view of the carrier case apparatus in its folded and/or suspended state showing positioning of the articles therein and the resealable entry means associated therewith.

FIG. 4 of the drawings shows carrier case 44 in its suspended state whereby compartments 39 and 38 suspend downwardly from flexible connection means 37. Resealable entry means 42 on the back side of compartment 38 is utilized to provide access to the interior of the compartment 38 through utilization of heavy-duty zipper 43. Roller skates 40 and 41 are thus capable of being conveniently carried in a facilitated manner by the user through suspension of the flexible connection means 37 over the shoulder, or through the carrying of the same in the hand. Through the utilization of handle 50 attached to the top surface of flexible connection means 37 and shown in dashed lines, carrying by a user's hand is further facilitated.

Figure 5:
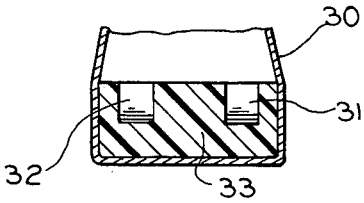
FIG. 5 is a front cross-sectional view of the article restraining means of FIG. 2, taken along line 5—5 and looking in the direction of the arrows.
Figure 6:
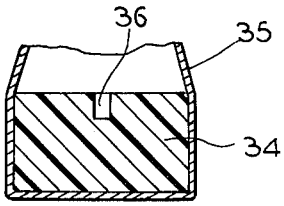
FIG. 6 is a front cross-sectional view of the article restraining means as shown in FIG. 3 of the drawings, taken along line 6—6 and looking in the direction of the arrows.

FIGS. 5 and 6 further show the details of the particular article restraint devices for roller skate wheels and ice skate blades, respectively. In FIG. 5, compartment 30 utilizes article restraint means 33 with indentations 31 and 32 in its upper surface to receive the wheels of a roller skate to thereby restrainably position said roller skate within the compartment. In equivalent fashion, article restraint means 34 in compartment 35 restrainably receives an ice skate blade in slot 36 to maintain the ice skate blade in a fixed position while reducing the possibilities of inadvertent dulling or scratching of the blade.

The foregoing description and drawings merely explain and illustrate the invention and the invention is not limited thereto, except insofar as the appended claims are so limited as those skilled in the art who have the disclosure before them will be able to make modifications and variations therein without departing from the scope of the invention.

What is claimed is:

1. An improved carrier case for carrying a pair of roller skates or ice skates or boots or other shoe-like articles comprising a first and second article compartment means for enveloping one each of a pair of said articles, respectively, each of said first and second compartment means being substantially L-shaped to closely approximate and surround the shape of said enveloped article; flexible connection means attached to the top portions of each of the first and second L-shaped compartment means connecting said top portions together, said flexible connection means comprising a substantially soft flexible flat band of material for placement alternately between a user's shoulder and a user's hand and from which said compartment means suspend when carried by said user; each of said two compartment means being attached to said flexible connection means in oppositely facing directions in order to balance the suspended weight of said compartment means and said articles on either side of a transverse axis through both said compartment means and connection means to facilitate handling by said user; article restraint means within the interior and along the bottom portions of each of said compartment means for restrainably maintaining the positions of said respective enveloped articles within said compartment means, each said article restraint means comprising one or more fixture devices in the bottom of said respective compartments, said fixture devices each having a top surface exposed to said article and having one or more indentations therein for snug and aligned receipt of a corresponding complementary portion of the article to be restrained within said compartments; and resealable entry means in each of said compartments for alternately exposing and sealing the interior of each of said compartment means to a user whereby insertion, storage and removal of the respective articles into and from said compartments may be effectively accomplished.

2. The improved carrier case according to claim 1 in which the invention further comprises padding means along the interior of each of said compartment means for further enveloping said articles respectively for added rigid restraint of said articles within each of said compartment means.

3. The invention according to claim 1 in which said flexible connection means further comprises:

separate handle means attached to the top facing side of said substantially flexible flat band of material thereby facilitating grasp of said carrier case invention by said user's hand.

4. The invention according to claim 1 in which said article restraint means are removable from each of said compartment means respectively to provide interchangeability among said article restraint means so as to convert said article carrier case from and ice skate carrying device to a roller skate carrying device thereby enabling said carrier case to protectively containg many types of articles including shoes and boots.

5. The invention according to claim 1 in which said resealable entry means are positioned along the back side of each of said L-shaped compartments for facilitated access into the interior of each of said compartments respectively.

* * * * *